US010850148B2

(12) United States Patent
Seaman et al.

(10) Patent No.: US 10,850,148 B2
(45) Date of Patent: Dec. 1, 2020

(54) TRAMPOLINE SAFETY ENCLOSURE

(71) Applicant: Action Sports Equipment Pty Ltd., Silverwater (AU)

(72) Inventors: Robert Brian Seaman, Silverwater (AU); David Andrew Jones, Silverwater (AU); Murray David Kirby Hunter, Silverwater (AU); Lee David Blattmann, Silverwater (AU)

(73) Assignee: ACTION SPORTS EQUIPMENT PTY LTD., Silverwater (AU)

( * ) Notice: Subject to any disclaimer, the term of this patent is extended or adjusted under 35 U.S.C. 154(b) by 108 days.

(21) Appl. No.: 16/072,061

(22) PCT Filed: Jan. 27, 2017

(86) PCT No.: PCT/AU2017/050071
§ 371 (c)(1),
(2) Date: Jul. 23, 2018

(87) PCT Pub. No.: WO2017/127898
PCT Pub. Date: Aug. 3, 2017

(65) Prior Publication Data

US 2019/0022447 A1 Jan. 24, 2019

(30) Foreign Application Priority Data

Jan. 27, 2016 (AU) ..... 2016900236

(51) Int. Cl.
*A63B 5/11* (2006.01)
*A63B 71/02* (2006.01)

(52) U.S. Cl.
CPC ..... *A63B 5/11* (2013.01); *A63B 71/022* (2013.01)

(58) Field of Classification Search
CPC ..... A63B 5/11
See application file for complete search history.

(56) References Cited

U.S. PATENT DOCUMENTS

| | | | | |
|---|---|---|---|---|
| 5,941,798 | A * | 8/1999 | Coan | A63B 5/11 482/27 |
| 7,611,443 | B2 * | 11/2009 | Publicover | A63B 5/11 482/27 |
| 7,641,594 | B2 * | 1/2010 | Hickey | A63B 5/11 239/289 |

(Continued)

FOREIGN PATENT DOCUMENTS

| | | | |
|---|---|---|---|
| AU | 2017201197 | A1 | 3/2017 |
| EP | 2 559 460 | A1 | 2/2013 |
| WO | 2015/009173 | A1 | 1/2015 |

OTHER PUBLICATIONS

International Search Report and Written Opinion for the International Application No. PCT/AU2017/050071, dated May 8, 2017, 11 pages.

(Continued)

*Primary Examiner* — Nyca T Nguyen
(74) *Attorney, Agent, or Firm* — Mai-Tram D. Lauer; Westman, Champlin & Koehler, P.A.

(57) ABSTRACT

This disclosure falls in the technical field of trampoline safety enclosures, and more particularly to trampolines including a support frame for a safety enclosure. A trampoline comprising a safety enclosure net is supported by furcated enclosure members, furcated at a furcation location above the level of the jumping mat. The safety enclosure is attached to a set of enclosure supporting members such that the supporting furcated members support the top of the safety enclosure. The disclosure also extends to furcated trampoline enclosure supporting members and method of supporting a trampoline enclosure.

18 Claims, 9 Drawing Sheets

(56) References Cited

U.S. PATENT DOCUMENTS

| | | | | |
|---|---|---|---|---|
| 7,762,927 | B1 * | 7/2010 | Gordon | A63B 5/11 482/27 |
| 8,012,066 | B1 * | 9/2011 | Hsiang | A63B 71/022 |
| 8,585,557 | B2 * | 11/2013 | Ikegami | A63B 71/022 482/27 |
| 9,399,152 | B2 * | 7/2016 | Yang | A63B 5/11 |
| 9,492,698 | B2 * | 11/2016 | Andon | A63B 5/11 |
| 9,682,264 | B1 * | 6/2017 | Chen | A63B 5/11 |
| D799,626 | S * | 10/2017 | Chen | A63B 5/11 D21/797 |
| D843,537 | S * | 3/2019 | Chen | A63B 71/022 D21/797 |
| 10,420,973 | B2 * | 9/2019 | Andon | A63B 71/022 |
| 2006/0194674 | A1 * | 8/2006 | Hickey | A63B 5/11 482/27 |
| 2009/0062078 | A1 * | 3/2009 | VanElverdinghe | A63B 5/11 482/29 |
| 2010/0240496 | A1 * | 9/2010 | Chen | A63B 5/11 482/27 |
| 2011/0256985 | A1 * | 10/2011 | Mann | A63B 5/11 482/27 |
| 2012/0142500 | A1 * | 6/2012 | Ronan | A63B 5/11 482/29 |
| 2012/0252634 | A1 * | 10/2012 | Ikegami | A63B 5/11 482/29 |
| 2012/0289379 | A1 | 11/2012 | Stokes et al. | |
| 2013/0045837 | A1 * | 2/2013 | Hsiang | A63B 5/11 482/27 |
| 2014/0228176 | A1 | 8/2014 | Miller et al. | |
| 2016/0030794 | A1 * | 2/2016 | Yang | A63B 5/11 482/27 |
| 2016/0045775 | A1 * | 2/2016 | Zhou | A63B 5/11 482/27 |

OTHER PUBLICATIONS

The International Preliminary Report on Patentability, dated Jul. 31, 2018, in corresponding international application No. PCT/AU2017/050071, filed Jan. 27, 2017; 7 pages.

* cited by examiner

TRAMPOLINE SAFETY ENCLOSURE

CROSS-REFERENCE TO RELATED APPLICATION

This Application is a Section 371 National Stage Application of International Application No. PCT/AU2017/050071, filed 27 Jan. 2017, and published as WO 2017/127898 A1 on Aug. 3, 2017, in English, the contents of which are hereby incorporated by reference in their entirety. International Application No. PCT/AU2017/050071 claims the benefit of priority of Australian application AU 2016900236, filed Jan. 27, 2016.

TECHNICAL FIELD

The present invention relates to a trampoline safety enclosure, and more particularly to a trampoline including a support frame for a safety enclosure.

BACKGROUND ART

A trampoline, at its essence, comprises: a jumping mat connected via tensioners to a frame, which frame is connected to the ground either directly or through legs.

Tensioners have traditionally been helical springs. Other tensioners are also known, for example elastomeric bands, rods or plates.

Standard above-ground trampolines are suspended above the ground by legs attached to the frame. In-ground trampolines have little or no distance between the bouncing mat and the ground.

In-ground trampolines typically have the frame connected directly to the ground, but in some instances, an above-ground trampoline can simply be placed in a hole dug to a depth such that the jumping mat is level with the ground. In both above-ground trampolines and in-ground trampolines, the use of safety enclosure nets is becoming commonplace.

A typical safety enclosure makes use of a net that circumextends around the jumping mat and is connected at its base to the jumping mat or to the frame. Variants are also known where the net is connected to padding located on tensioners or sleeves on the tensioners. The safety net needs to be secured at it top end to a supporting structure.

The safety enclosure is generally of sufficient height to prevent a typical user from jumping outside of the trampoline jumping mat area onto the surrounding ground, which could result in injury. In the case of a net attached inboard of the frame, the net also helps to prevent contact of the user with the frame, which again helps to prevent injury.

The safety net supporting structure is typically a set of vertical poles connected to the frame or to the legs of the trampoline and which extend above the jumping mat height to a sufficient distance to enable the net to be attached to the poles at the net's maximum height. Other variations, such as the use of arcuate supports are also known.

The number of supports typically varies depending on the size of the trampoline and can be anything from 3 to 8 supports.

The net at the top is traditionally attached to the supporting structure by way of a circular supporting hoop that is attached to the net and, in turn, attached to the supporting structure. However, the net can be directly attached to the supporting poles or connected by leads in the faun of short segments of rope or fabric strips. The ropes and fabric strips can optionally be elastomeric.

In order for the enclosure to be as safe as possible and remain so, the enclosure must be properly supported so it does not sag. Sagging and distortion between supports often occurs through sagging of the net and hoop (if fitted) under its own weight if not properly supported. Sagging can also become more pronounced as a trampoline ages. It can also occur when the support attachments degrade. The hoop (if present) at the top can also crack or bow from fatigue, especially if forces applied to it are not adequately distributed.

One way to prevent or delay sagging, cracking and bowing have included increasing the number of supporting poles that are used. This does provide some additional support to the net and hoop (if present) and spreads the load at the top of the net. Unfortunately, increasing the number of support poles increases the cost and weight of the trampoline and increases complexity of installation and maintenance. On smaller trampolines, a large number of support poles can also limit access to the trampoline due to restricted width between each support pole. The increased number of poles can also be a safety hazard as this provides additional potential contact points for a user to strike against if travelling horizontally.

Nothing above should be read as necessarily falling within the common general knowledge.

Definitions

In this specification:

1. "circumextends" means surrounding the periphery of another object in a closed loop. In the context of a trampoline, the periphery of the jumping mat is typically surrounded. The object that is traced can be of any shape, such as circular, rectangular and polygonal;
2. "periphery" means the outside edge of a sheet-like object. In the case of a jumping mat, this is the outermost border that a trampoline user has access to while still being inside the usable area of the jumping mat;
3. "tensioner" means any resiliently deformable mechanism that in concert with other tensioners allows the jumping mat to deform from its resting configuration when a user jumps on the jumping mat with sufficient force and then forces the jumping mat to resiliently return towards its resting configuration to apply sufficient force to the user such that the user is propelled upwards to become briefly airborne;
4. "furcate" means to divide into two or more elements. In the context of enclosure support members, the multiple branched elements are operatively located above the unbranched elements.
5. "bifurcate" means to divide into two elements;
6. "trifurcate" means to divide into three elements;
7. "proximal" or "proximate" means situated at or near a defined location;
8. "joint" means a support that holds and acts as a connector to join two or more parts. Typically, these are composed of metal or plastics, but other materials are known and used in the art;
9. "comprise", or variations such as "comprises" or "comprising", will be understood to imply the inclusion of a stated element, integer or step, or group of elements, integers or steps, but not the exclusion of any other element, integer or step, or group of elements, integers or steps.

The art-skilled worker will appreciate that the above definitions can and should, with suitable amendment for context, apply to the singular and the plural, and also to the tense of verbs, adjectives and adverbs derived from the above terms.

SUMMARY OF THE INVENTION

In a first aspect, the present invention provides a trampoline comprising:

a) a jumping mat having a periphery;
b) a set of tensioning members connected to the jumping mat;
c) a supporting frame connected to the tensioning members;
d) a safety enclosure that circumextends the periphery of the jumping mat;
e) the safety enclosure being connected at its base at or inboard of the supporting frame;
f) the safety enclosure extending above the level of the jumping mat;
g) a set of enclosure supporting members connected either directly or indirectly to the frame;
h) the set of enclosure supporting members extending above the level of the jumping mat;
i) wherein at least one of the enclosure supporting members is furcated at a furcation location above the level of the jumping mat to form furcated members;
j) the safety enclosure is attached to the set of enclosure supporting members such that the supporting members support the top of the safety enclosure;
k) wherein the furcated members support the top of the safely enclosure.

The present invention also extends to furcated trampoline enclosure supporting members.

In a further aspect, the present invention provides a method of supporting a trampoline enclosure comprising:

a) providing a trampoline and enclosure net comprising:
   a. a jumping mat having a periphery;
   b. a set of tensioning members connected to the jumping mat;
   c. a supporting frame connected to the tensioning members;
b) providing the said enclosure, comprising:
   a. a safety enclosure that circumextends the periphery of the jumping mat;
   b. the safety enclosure being connected at its base at or inboard of the supporting frame;
   c. the safety enclosure to be extended above the level of the jumping mat;
c) providing a set of enclosure supporting members connected either directly or indirectly to the frame;
d) erecting the set of enclosure supporting members such that they extend above the level of the jumping mat;
e) wherein at least one of the enclosure supporting members is furcated at a furcation location above the level of the jumping mat to form furcated members;
f) attaching the safety enclosure to the set of enclosure supporting members such that the supporting members support the top of the safety enclosure; and
g) wherein the furcated members support the top of the safely enclosure.

BRIEF DESCRIPTION OF THE DRAWINGS

The invention is described below with reference to non-limiting drawings in which.

DETAILED DESCRIPTION OF THE INVENTION

Figure 1:
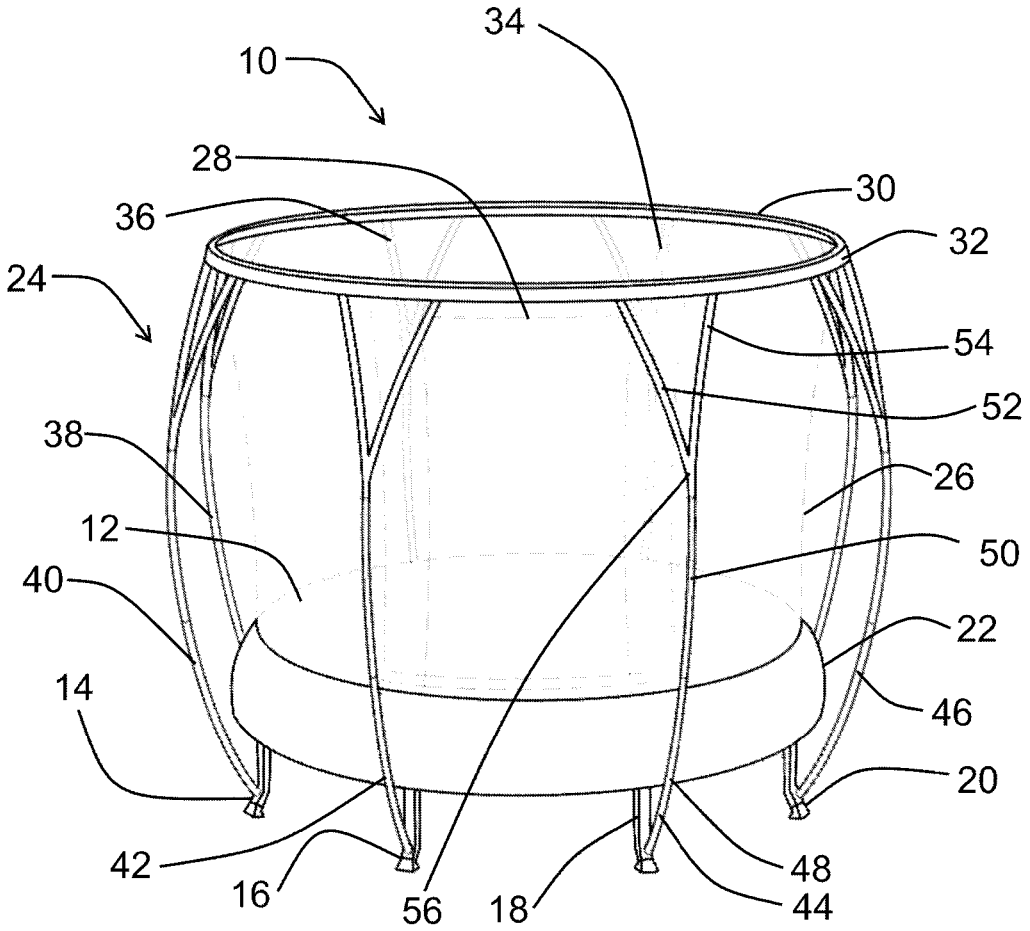
FIG. 1 is a perspective view of a trampoline with furcated support poles.

In accordance with the first aspect, generally provided is a trampoline with a safety enclosure is provided that has at least one furcated enclosure supporting member. The following features apply both to the first and further aspects.

Preferably, the trampoline comprises a plurality of furcated enclosure supporting members, more preferably where the furcation location on each of the plurality of furcated enclosure supporting members takes place at a generally common height. The enclosure supporting members are preferably generally elongated, more preferably hollow poles.

It is most preferred that all of the enclosure supporting members are furcated.

It is also preferred that the at least one of the enclosure supporting members that is furcated is bifurcated or alternatively trifurcated.

The furcation preferably occurs above half the overall height of the enclosure supporting member above the level of the jumping mat. This allows, for example, less enclosure support material to be used and provides fewer obstacles near the level of the jumping mat for the user to come into contact with.

The members should preferably terminate at a common general height above the surface of the jumping mat.

In a currently preferred embodiment, the enclosure supporting members proximal their upper ends support the top of the safety enclosure. Preferably, each enclosure supporting member is attached to the safety enclosure by way of a joiner attached proximal the top of the safety enclosure, wherein the joiner more preferably is selected from the group consisting of: a slotted cap, a loop of fabric, a non-elastic cord, a metal clip (most preferably a steel D-clip), a carabiner and combinations of these.

In a currently preferred embodiment, the furcated enclosure supporting member uses the same profile and profile dimensions of material below and above the furcation. Alternatively, one or more of: a different material, a different profile and different profile dimensions can be employed. Where different profile dimensions are used, it is preferred for the dimensions of the furcated elements above the furcation to be smaller than those of the unfurcated portion of the member below the furcation.

The furcated enclosure supporting member can be made of any suitable materials that traditional trampoline enclosure supporting members are made from. Non-limiting examples include: metal piping (preferably steel), plastics and carbon fibre. The enclosure supporting members can be rigid or flexible. It is currently preferred that they are rigid hollow rounded steel pipe.

The furcated enclosure supporting member can be made in a single moulded piece or in a piece that has been glued or welded. However, it more practically comprises multiple elements that are assembled during trampoline assembly to form the furcated enclosure supporting member. The elements can be linear, but it is currently preferred that they are generally arcuate.

Where multiple elements are used to form the furcated enclosure supporting member, the elements may conveniently comprise multiple furcated elements and one unfurcated element. Any of the elements may be composed of a single piece but these can also be composed of multiple segments joined together to form the element. Conveniently, the elements can be generally elongate.

The unfurcated element is preferably disposed generally upright. The furcated elements may be generally upright or angled off the vertical.

The multiple elements can be joined in any way that elements are joined together proximal the furcation location. Non-limiting examples include: welding, gluing and fastening. It is currently preferred that a joint is provided at the furcation location that has receiving formations that receives and secures one end of each of the multiple elements and retains these elements in a defined relationship.

In the case of a bifurcated enclosure supporting member, this comprises at least one unfurcated element and two furcated elements. The furcated elements are preferably splayed from one another at an included angle of between 10 and 60 degrees measured at the furcation location, more preferably at an angle of between 15 and 45 degrees.

The tops of the enclosure supporting members (furcated and unfurcated) are preferably generally evenly spaced around and generally above the periphery of the jumping mat to spread the load on the top of the safety enclosure.

The present invention extends to a furcated enclosure supporting member either alone or as part of a trampoline.

EXAMPLES

The invention is described below with reference to examples. The examples are only preferred embodiments of one or more ways that the invention can be carried out and should not be read as limiting the scope of the invention.

With reference to FIG. 1, a trampoline generally indicated by 10 has a jumping mat and frame assembly 12. The frame assembly is connected to a series of legs 14, 16, 18, 20, 22 by way of T joints (not shown), which are standard in the industry. A further 3 legs are not shown as they are hidden by the jumping mat and frame assembly. A skirt 22 is also provided, which is a fabric cover that is connected to the edge of the frame assembly 12. The skirt includes padding (not shown).

The trampoline includes an enclosure, generally indicated as 24. This has an enclosure net 26 connected at its bottom end to the periphery of the jumping mat and frame assembly 12. The net includes a zipped access flap 28. At its top, the enclosure net 26 is connected to a support hoop 30. A support flap 32 is also provided, which is a strip of material parallel to enclosure 26 located beneath support hoop 30.

8 rigid round steel tube support poles: 34, 36, 38, 40, 42, 44, 46 are provided composed of hollow 32 mm outer diameter, 1.2 mm galvanised steel pipe. Support poles 40, 42, 44, 46 are connected to legs 14, 16, 18, 20, respectively. Likewise, support poles 34, 36, 38 are connected to legs (not shown).

Each of the 8 supporting poles 34, 36, 38, 40, 42, 44, 46 are identical. Only support pole 44 will be discussed in detail as a result. The other support poles 34, 36, 38, 40, 42, 46 each have the same features.

Support pole 44 comprises a lower unfurcated segment 48 attached to leg 18. The upper end of segment 48 is a spigot (not shown) inserted within an upper unfurcated segment 50. Above upper unfurcated segment 50 are two symmetrical furcated segments 52 and 54 splayed from the upper unfurcated segment 50 at an angle of 15°. Furcated segments 52, 54 and upper unfurcated to segment 50 are connected by way of a joint 56.

Upper furcated segments 52 and 54 are connected to support hoop 30 at their respective upper ends.

In use, each of the furcated segments of the 8 supporting poles 34, 36, 38, 40, 42, 44, 46 are connected to and support the upper end of enclosure net 26, thereby spreading the load of the weight of enclosure net 26 and hoop 30.

A user is able to gain access to the trampoline through zipped access flap 28 by zipping it. In the configuration as shown in FIG. 1, the upper furcated segments of support poles 42 and 48 do not interfere with the user gaining access to the trampoline through the zipped access flap 28.

Figure 2:
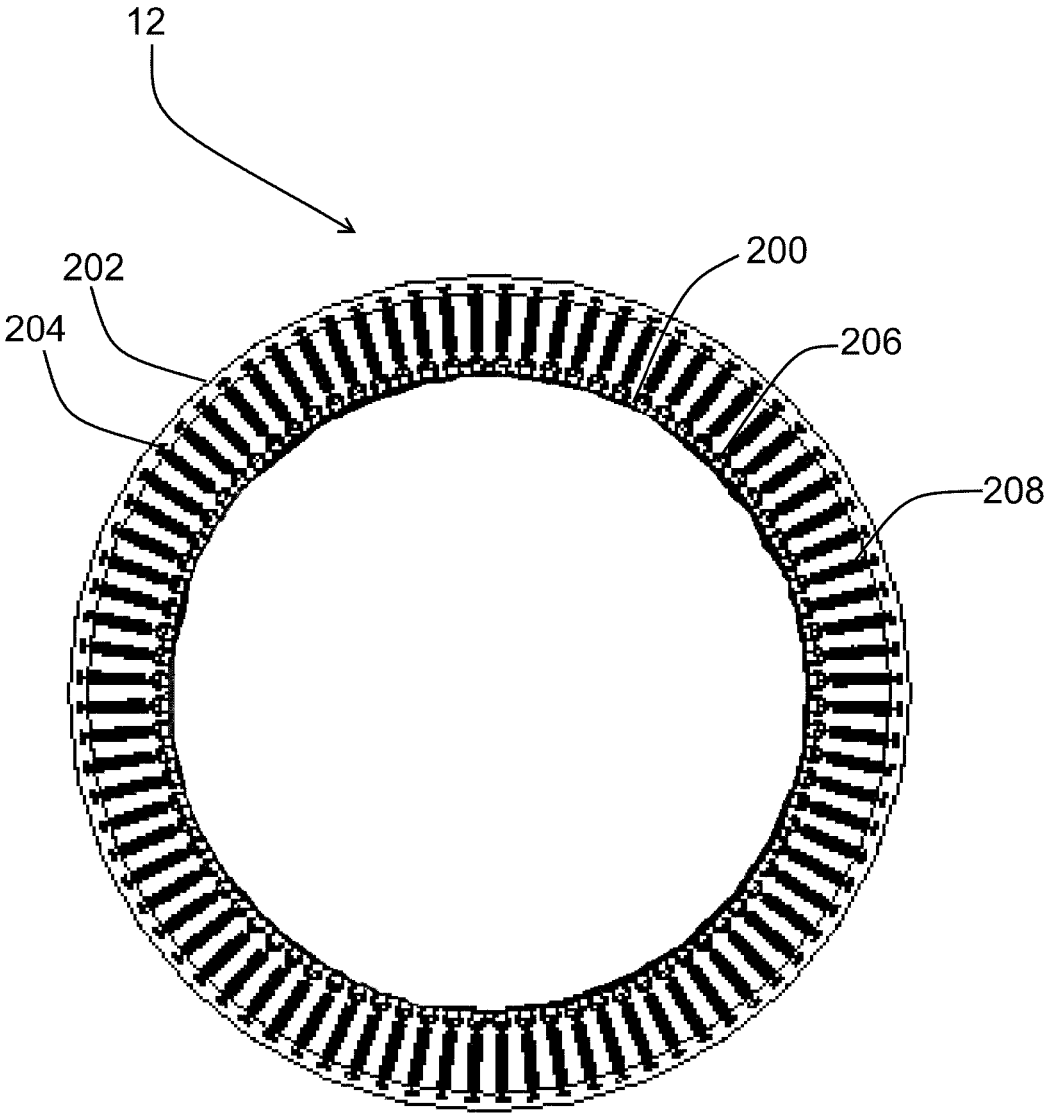
FIG. 2 is a plan view of a jumping mat and frame assembly of FIG. 1.

With reference to FIG. 2, the jumping mat and frame assembly 12 as depicted in FIG. 1 is described in detail.

A jumping mat 200 is connected to a segmented frame 202. The segmented frame has a plurality of holes 204 (only one is indicated by the reference numeral in the interests of simplifying the drawing). Jumping mat 200 has a plurality of mat attachments 206 (only one is indicated by the reference numeral in the interests of simplifying the drawing) evenly located around its periphery that are complementary to the plurality of holes 204. A plurality of helical spring tensioners 208 (only one is indicated by the reference numeral in the interests of simplifying the drawing) connect each of the plurality of holes 204 to the complementary each of the plurality of mat attachments 206.

Figure 3:
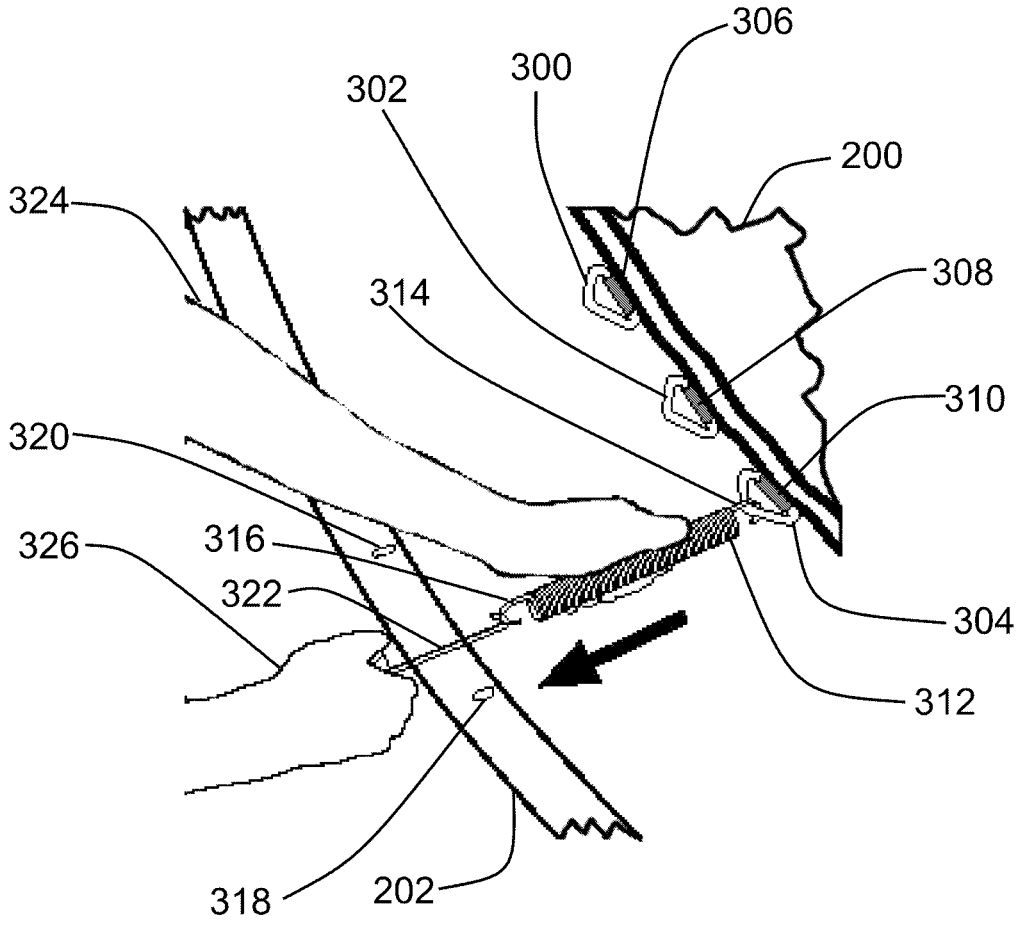
FIG. 3 is a cut-away isometric view of installation of helical spring tensioners shown in FIG. 2.

With reference to FIG. 3, the installation of helical spring tensioners is described in relation to a single tensioner.

Jumping mat 200 has a plurality of delta wire loops 300, 302, 304 (only a small subset are shown). Each of the delta wire loops 300, 302, 304 are attached to jumping mat 200 by folded and sewed fabric tabs 306, 308, 310. The combination of a delta wire loop and sewed fabric tab is a mat attachment 206 (FIG. 2).

A helical spring tensioner 312 has a mat hook 314 and a frame hook 316. A user 326 connects mat hook 314 through delta loop 304. Only two of the plurality of holes 204 (FIG. 2) in segmented frame 202 (FIG. 2) are shown (316 and 318). Frame hook 316 is oriented in the direction of a complementary hole 318 in segmented frame 202.

A pulling tool 322 is attached to frame hook 316. The user places their left-hand 324 over helical spring tensioner 312 to steady it while applying tension to pulling tool 322 in the direction of hole 318 as shown by the arrow. Once the frame hook 316 is in position over hole 318, frame hook 316 is hooked into hole 318 to secure helical spring tensioner 312 into position.

Similarly, a second spring tensioner (not shown) is installed between delta loop 302 and hole 320. The process is repeated until all of the plurality of helical spring tensioners 208 as shown in FIG. 2 are installed.

Figure 4:
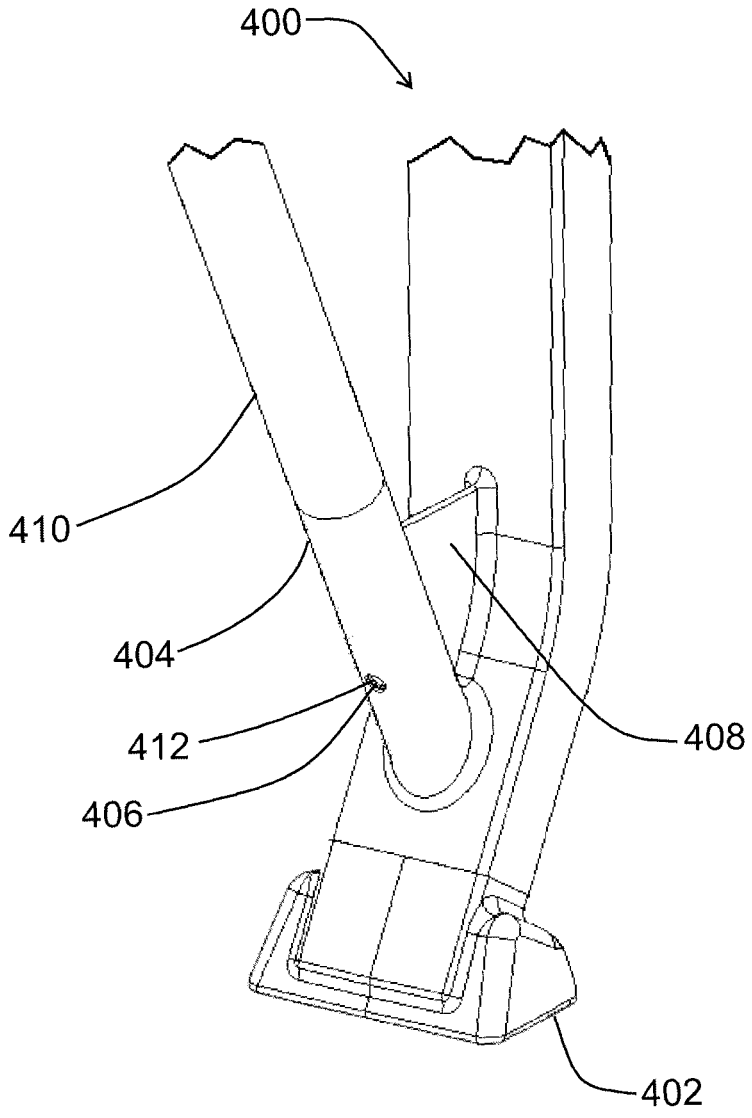
FIG. 4 is an isometric cut-away view of a leg of the trampoline shown in FIG. 1.

With reference to FIG. 4, a base of a leg (identical in each of the series of legs 14, 16, 18, 20, 22 in FIG. 1) is depicted 400. The base of the leg generally indicated as 400 is a shoe 402, which contacts the ground in use. A pole socket 404, with a hole 406, is angled away from the general direction of the leg 400. An angled support 408 assists in defining this angle.

An unfurcated bottom segment end 410 (that would be the appropriate one of 8 round steel tube support poles: 34, 36, 38, 40, 42, 44, 46 as depicted in FIG. 1) is swaged at its lower end so that it fits within pole socket 404. Once inserted, a spring clip (not shown) is used to lock segment end 410 into pole socket 404 such that a spring clip button 412 protrudes from hole 406. If spring clip button 412 is depressed by a user, this can be used to release segment end 410 from pole socket 404.

Figure 5:
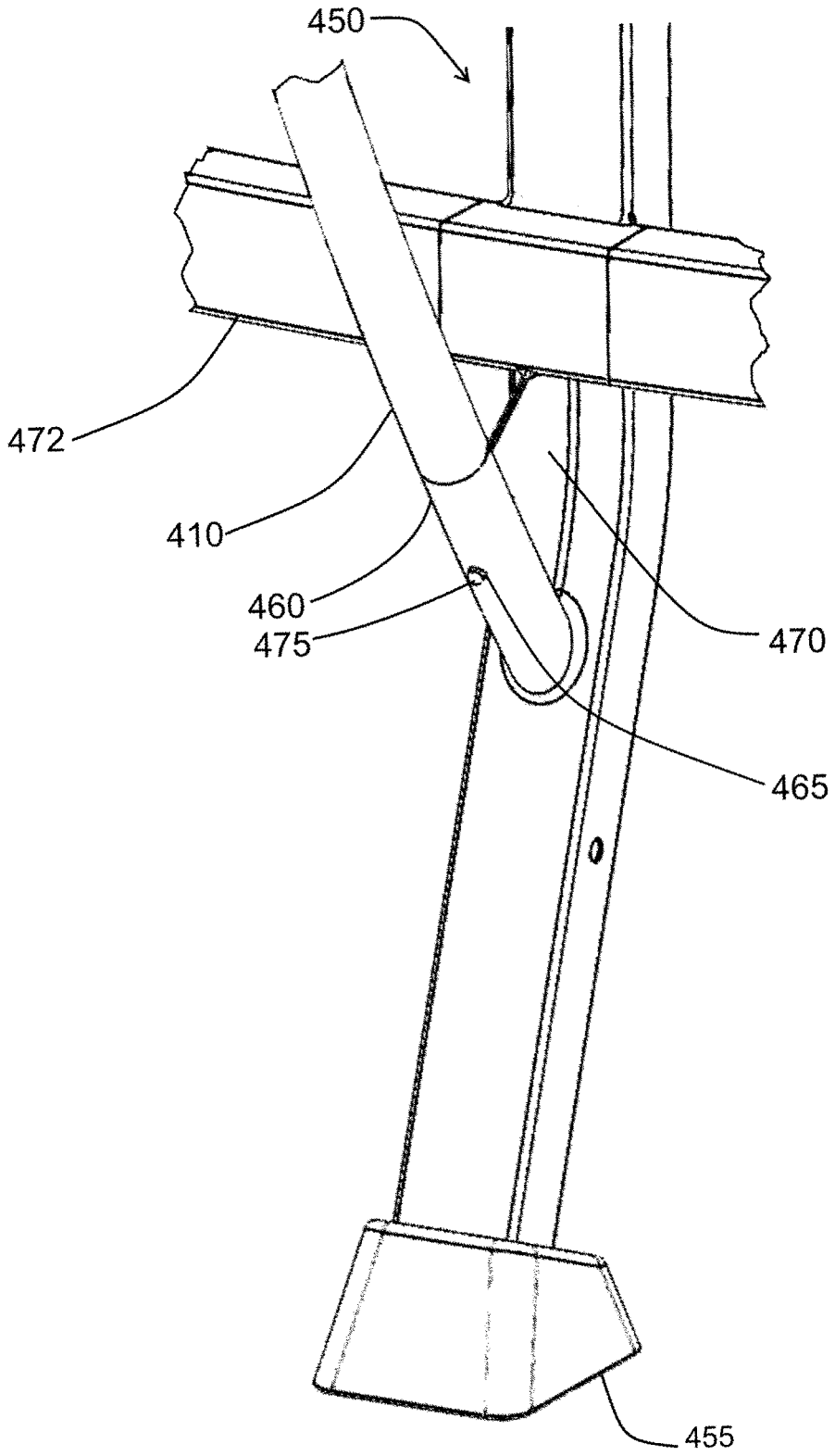
FIG. 5 is an isometric cut-away view of a currently preferred leg of a trampoline similar to that shown in FIG. 4.

With reference to FIG. 5, a base of a leg similar to that in FIG. 4 is depicted. The base of the leg generally indicated as 450 is a shoe 455, which contacts the ground in use. A pole socket 460, with a hole 465, is angled away from the general direction of the leg 450. An angled support 470 assists in defining this angle. Above that is a cut-away of a trampoline supporting ring 472

An unfurcated bottom segment end 410 (that would be the appropriate one of 8 round steel tube support poles: 34, 36, 38, 40, 42, 44, 46 as depicted in FIG. 1) is swaged at its lower end so that it fits within pole socket 460. Once inserted, a spring clip (not shown) is used to lock segment end 410 into pole socket 460 such that a spring clip button 475 protrudes from hole 465. If spring clip button 475 is depressed by a user, this can be used to release segment end 410 from pole socket 460.

Figure 6:
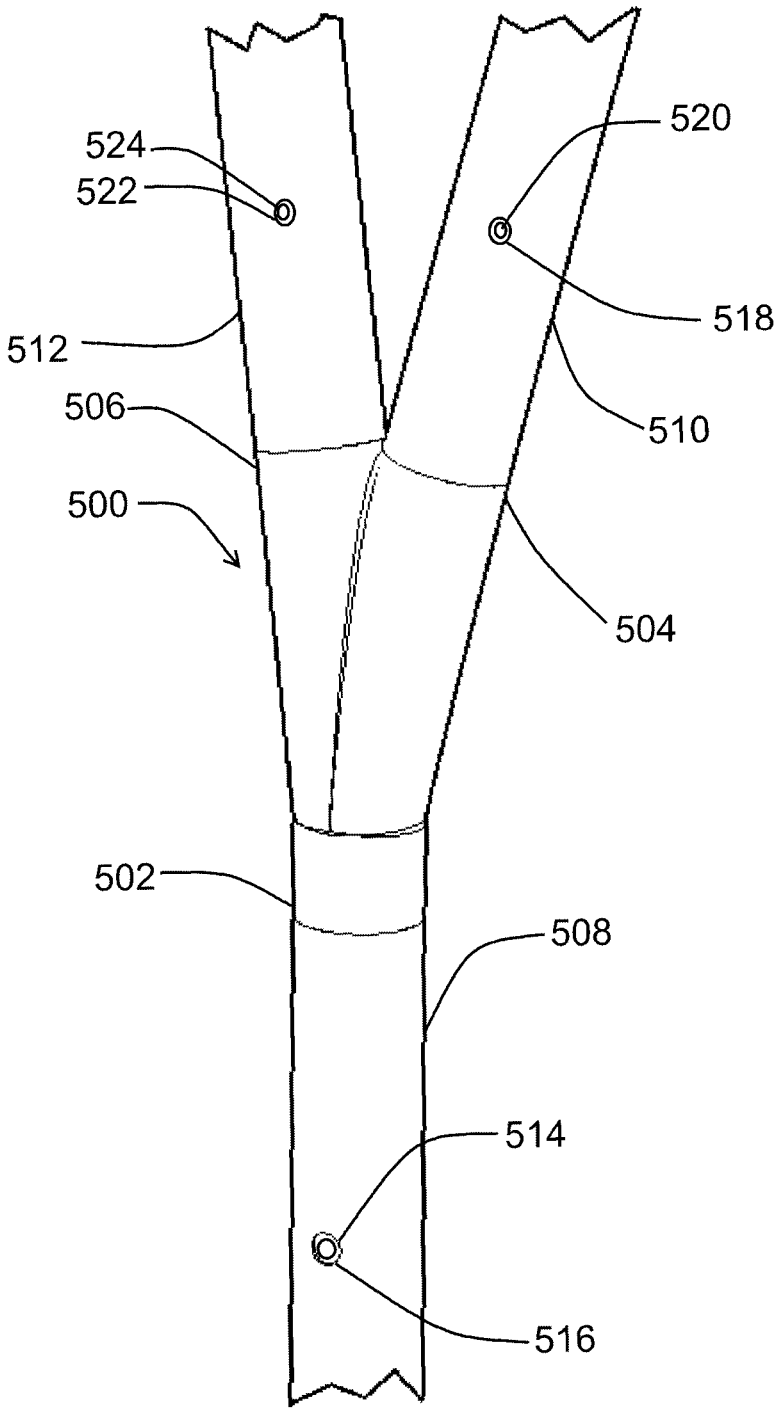
FIG. 6 is a perspective view of a joint of a furcated support pole shown in FIG. 1.

With reference to FIG. 6, the area surrounding joint 56 in FIG. 1 is described in detail.

A plastics moulded joint 500 has a lower spigot 502 at its base and a pair of upper spigots 504, 506 on its operatively upper end. The upper spigots 504, 506 are splayed at an angle of 15° from one another. Joint 500 is bilaterally symmetrical.

The operatively upper end 508 of upper unfurcated segment (50 in FIG. 1) is hollow and able to receive lower spigot 502. Lower spigot 502 is inserted into upper end 508.

Similarly, furcated segments 52 and 54 in FIG. 1 also have hollow lower ends 510, 512 able to receive upper spigots 504, 506, respectively. Upper spigots 504, 506 are inserted into lower ends 510, 512, respectively.

A hole 514 is formed in upper end 508. Once lower spigot 502 is inserted into upper end 508, a spring clip (not fully shown) is used to lock lower spigot 502 into upper end 508 such that a spring clip button 516 protrudes from hole 514. If spring clip button 516 is depressed by a user, this permits release of lower spigot 502 from upper end 508.

Holes 518 and 522 are formed in lower ends 510, 512, respectively. Once lower ends 510, 512 receive upper spigots 504, 506, a spring clip (not fully shown) in each lower end 510, 512 is used to lock lower ends 510, 512 in upper spigots 504, 506, such that spring clip buttons 520, 524 protrude from holes 518, 522, respectively. If spring clip button 520 is depressed by a user, this permits release of lower end 510 from upper spigot 504. Similarly, if spring clip button 524 is depressed by a user, this permits release of lower end 512 from upper spigot 506.

Figure 7:
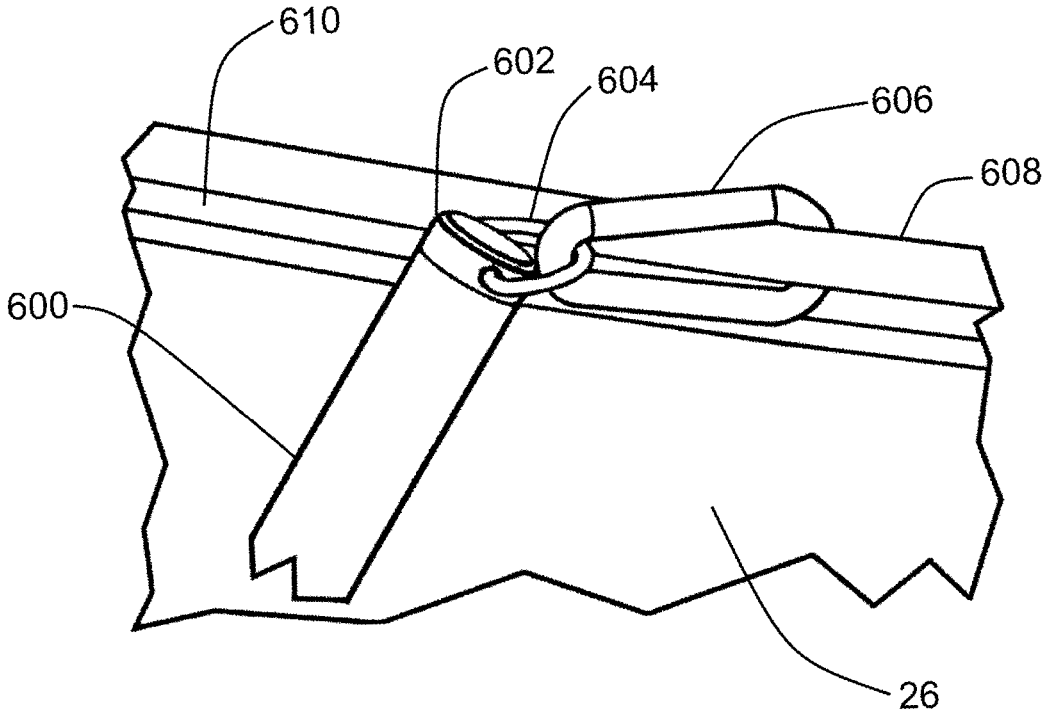
FIG. 7 is a cut-away view of the top of a furcated segment as shown in FIG. 1.

With reference to FIG. 7, upper end 600 of furcated segment 54 in FIG. 1 is shown. A portion of the enclosure net 26 (FIG. 1) is also shown.

A plastic spigot cap 602 is driven into upper end 600, which is hollow. A wire D-loop 604 passes through plastic 602, which is in turn connected to a carabiner 606, in turn connected to a hoop portion 608 of hoop 30 shown in FIG. 1.

Ordinarily, support flap 32 in FIG. 1 is located such that it conceals plastic spigot 602, D-loop 604 and carabiner 606. In the current figure, support flap 610 is folded back for ease of access and illustrative purposes.

Figure 8:
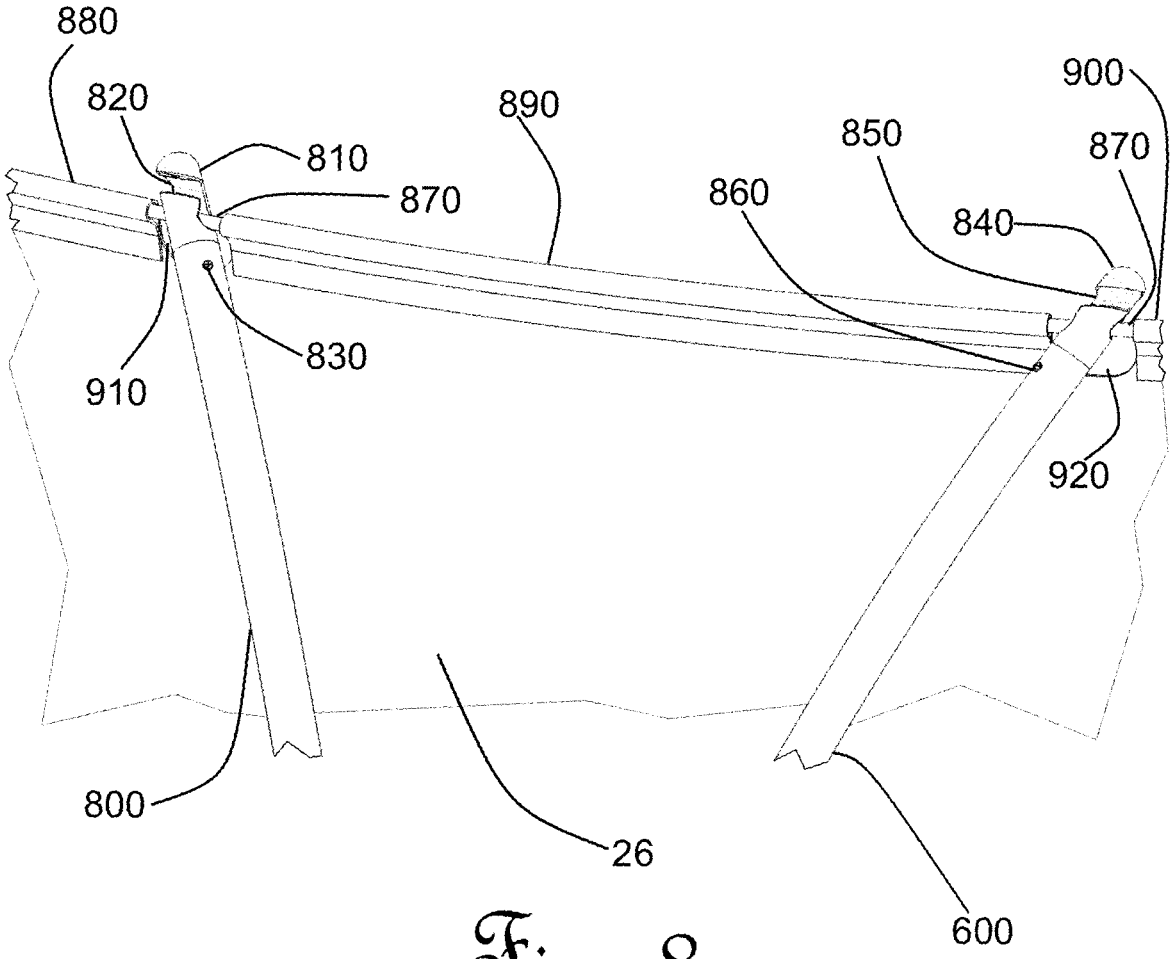
FIG. 8 is a cut-away view of both elements at the top of a furcated segment.

With reference to FIG. 8, an upper end 800 of furcated segment 52 in FIG. 1 is shown. Also shown is a portion of enclosure net 26.

A left plastic slotted spigot cap 810, having a hoop receiving cavity 820, is driven into upper end 800, which is hollow and has a hole (not shown) that permits a release button 830 to protrude. The release button 830 prevents rotation of the spigot cap 810 within the upper end 800 and can also, when depressed, be used to release the spigot cap 810 from the upper end 800.

An upper end 600 of furcated segment 54 in FIG. 1 is also shown. A right plastic slotted spigot cap 840, having a hoop receiving cavity 850, is driven into upper end 600, which is hollow and has a hole (not shown) that permits a release button 860 to protrude. The release button 860 prevents rotation of the spigot cap 840 within the upper end 600 and can also, when depressed, be used to release the spigot cap 840 from the upper end 600.

A hoop portion 870 of support hoop 30 (FIG. 1) passes through a left sleeve 880, central sleeve 890 and right sleeve 900 at the upper end of enclosure net 26 and is exposed in a left aperature 910 and right aperture 920. Hoop portion 870 is slotted into the plastic slotted spigot cap 810 and seated into the hoop receiving cavity 820, such that it is prevented from dislodging. Similarly, Hoop portion 870 is slotted into the plastic slotted spigot cap 840 and seated into the hoop receiving cavity 850, such that it is prevented from dislodging.

Figure 9:
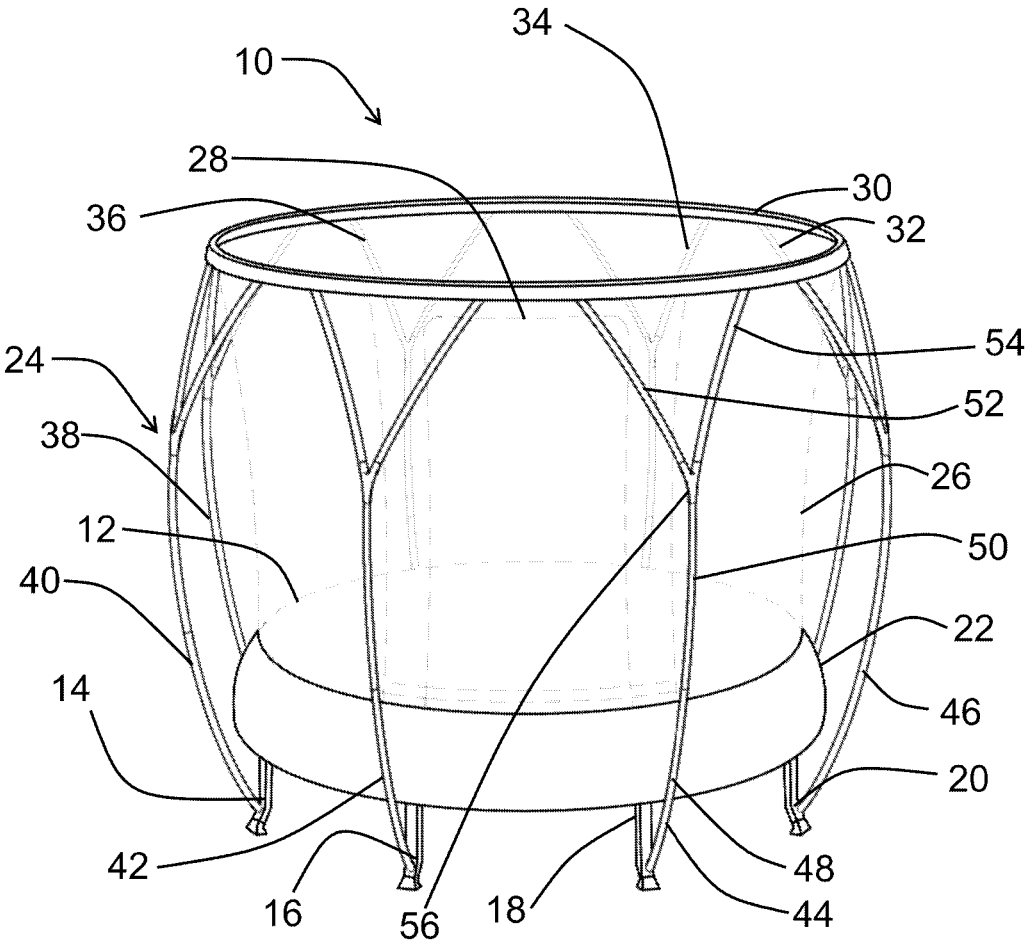
FIG. 9 is a perspective view of an alternative embodiment with furcated support poles.

With reference to FIG. 9, an alternative example of a furcated support pole is shown. The same reference numerals as are present in FIG. 1 have been used as each of the elements is identical other than the furcated support poles, which have a greater angle between splayed furcated segments 52, 54 of 30°.

The advantage of the greater angle of the present figure is a better spread of load. However, there is a compromise in that the very top of zipped access flap 28 is less accessible to a user.

It will be appreciated by art skilled workers that a number of variations can be made to the above examples without departing from the scope of the present invention. In particular:

a. While 8 furcated supports are shown in the present examples, any number of supports can be used, providing the angles between furcated segments are adjusted to give a reasonable spread of load of the enclosure. Typically, trampolines have between 3 and 8 supports.

b. While a hoop is employed in the present example, it is known in the art that no hoop is necessarily required in order to support an enclosure net. Accordingly, the furcated segments can be directly connected to the net or any other support structure at the top of the enclosure.

c. A trifurcated enclosure support pole can also be used. In a trifurcated example, a third furcated segment is provided extending generally along the plane of symmetry. At its peak, the third furcated segment is shorter than the splayed furcated segments so as to end at the same general height as the splayed furcated segments.

d. Any tensioning means can be employed, such as elastomeric bands. The invention is not restricted to any particular tensioning means.

e. While the enclosure net at its base is connected to the periphery of the jumping mat, it can equally be connected to any part of a trampoline between the mat and the support frame.

f. The support poles are shown as being integrated within the trampoline structure. However, support poles can be sold as an aftermarket product. As an aftermarket product, they are typically provided with attachment kits, which attach to the legs or support frame of the trampoline. Any form of attachment, being direct or indirect to the trampoline frame or trampoline legs are included.

g. Support poles are made from a variety of materials in the art ranging from hollow metal pipes of various cross sectional shapes and sizes. Support poles can also be made of other substances, such as plastics and carbon fibre. The present invention lends itself to adaptation to any of these different materials.

h. Support poles in the present examples are shown as bowed arcuate in shape. The invention is equally applicable to any other type of support pole configuration, whether arcuate, angled or straight.

i. Support poles can be segmented, such as shown in the present examples or manufactured as a single piece.

j. The general splaying of the furcated segments is a practical way of minimising material. However, other aesthetic designs that furcate a support pole are also contemplated.

k. Spigot cap 602 (FIG. 7) can be coupled to the net by use of any techniques known in the art, including but not limited to: a loop of fabric, non-elastic cord and a metal clip.

It will be appreciated that the invention broadly consists in the parts, elements and features described in this specification, which when compared to prior art relating to the field, should serve to illustrate the novelty of the invention described herein.

INDUSTRIAL APPLICABILITY

The present invention is applicable to the trampoline manufacturing industry and to the construction and maintenance of trampolines.

The invention claimed is:

1. A trampoline comprising:

a jumping mat having a periphery;

a set of tensioning members connected to the jumping mat;

a supporting frame connected to the set of tensioning members;

a safety enclosure that circumextends the periphery of the jumping mat;

the safety enclosure being connected at its base at or inboard of the supporting frame;

the safety enclosure extending above a level of the jumping mat;

a set of enclosure supporting members connected either directly or indirectly to the frame;

the set of enclosure supporting members extending above the level of the jumping mat;

wherein at least one of the enclosure supporting members is furcated from an unbranched supporting member element extending generally upright into two or more branched elements at a furcation location above the level of the jumping mat to form a furcated member, wherein the branched elements are operatively located above the unbranched supporting member element, and wherein the branched elements are splayed from one another at their operatively top ends;

wherein the safety enclosure is attached to the set of enclosure supporting members such that the supporting members support a top of the safety enclosure; and wherein the furcated member supports the top of the safely enclosure; and a support hoop connected to the operatively top end of each of the branched elements above the furcation location.

2. The trampoline as claimed in claim 1, wherein the trampoline comprises a plurality of said furcated members.

3. The trampoline as claimed in claim 2, wherein the furcation location of each of the plurality of furcated members is at a generally common height.

4. The trampoline as claimed in claim 2, wherein all of the set of enclosure supporting members are furcated.

5. The trampoline as claimed in claim 3, wherein tops of the set of enclosure supporting members are generally evenly spaced around and generally above the periphery of the jumping mat such that they spread a load on the top of the safety enclosure.

6. The trampoline as claimed in claim 1, wherein the set of enclosure supporting members proximal their upper ends support the top of the safety enclosure.

7. The trampoline as claimed in claim 6, wherein each of the set of enclosure supporting members is attached to the safety enclosure by way of a joiner attached proximal the top of the safety enclosure.

8. The trampoline as claimed in claim 1, wherein the furcation location is above half an overall height of the enclosure supporting member above the level of the jumping mat.

9. The trampoline as claimed in claim 1, wherein the enclosure supporting members are generally elongated hollow poles.

10. The trampoline as claimed in claim 1, wherein the at least one of the enclosure supporting members that is furcated is bifurcated.

11. The trampoline as claimed in claim 7, wherein the joiner is selected from the group consisting of: a slotted cap, a loop of fabric, a non-elastic cord, a metal clip, a carabiner and combinations of these.

12. The trampoline as claimed in claim 1, wherein the furcated member uses a same profile and profile dimensions of material below and above the furcation location.

13. The trampoline as claimed in claim 1, wherein the furcated member comprises a hollow rounded steel pipe.

14. The trampoline as claimed in claim 1, wherein the branched elements are generally arcuate.

15. The trampoline as claimed in claim 1, wherein a joint provided at the furcation location has a formation configured to receive and secure one end of each of the branched elements and retain these branched elements in a defined relationship.

16. The trampoline as claimed in claim 1, wherein the branched elements are splayed from one another at an included angle of between 10 and 60 degrees measured at the furcation location.

17. The trampoline as claimed in claim 1, wherein the branched elements are splayed from one another at an included angle of between 15 and 45 degrees.

18. A method comprising:

providing a trampoline and enclosure net comprising:

a jumping mat having a periphery;

a set of tensioning members connected to the jumping mat; and a supporting frame connected to the set of tensioning members;

said enclosure net comprising a safety enclosure that circumextends the periphery of the jumping mat;

the safety enclosure being connected at its base at or inboard of the supporting frame; and the safety enclosure to be extended above a level of the jumping mat;

providing a set of enclosure supporting members connected either directly or indirectly to the frame;

erecting the set of enclosure supporting members such that they extend above the level of the jumping mat;

wherein at least one of the enclosure supporting members is furcated from an unbranched supporting member element extending generally upright into two or more branched elements at a furcation location above the level of the jumping mat to form a furcated member, wherein the branched elements are operatively located above the unbranched supporting member element and wherein the branched elements are splayed from one another at their operatively top ends;

connecting each of the branched elements at its operatively top end to a support hoop above the furcation location:

attaching the safety enclosure to the set of enclosure supporting members such that the supporting members support a top of the safety enclosure; and wherein the furcated member supports the top of the safely enclosure.

* * * * *